United States Patent [19]

Sanai

[11] Patent Number: 5,028,752

[45] Date of Patent: Jul. 2, 1991

[54] PUSH BUTTON DEVICE

[75] Inventor: Yukiharu Sanai, Hyogo, Japan

[73] Assignee: Mitsubishi Denki Kabushiki Kaisha, Tokyo, Japan

[21] Appl. No.: 430,247

[22] Filed: Nov. 2, 1989

Related U.S. Application Data

[63] Continuation-in-part of Ser. No. 299,636, Jan. 23, 1989, abandoned.

[30] Foreign Application Priority Data

Apr. 28, 1988 [JP] Japan ..... 63-108103

[51] Int. Cl.[5] ..... H01H 3/12

[52] U.S. Cl. ..... 200/341; 200/345

[58] Field of Search ..... 200/341, 344, 345, 511, 200/512, 513, 517, 530, 290, 5 A; 400/490, 491, 491.1, 491.2, 495, 495.1

[56] References Cited

U.S. PATENT DOCUMENTS

| | | | |
|---|---|---|---|
| 2,981,816 | 4/1961 | Cozart | 200/341 |
| 3,806,685 | 4/1974 | Seeger et al. | 200/511 |
| 3,928,741 | 12/1975 | Comer | 200/345 |
| 3,996,430 | 12/1976 | Eberwein et al. | 200/517 |
| 4,256,931 | 3/1981 | Palisek | 200/517 |
| 4,314,113 | 2/1982 | Nelson | 200/345 |
| 4,324,472 | 4/1982 | Terada et al. | 200/511 |
| 4,354,081 | 10/1982 | Serras-Paulet | 200/345 |
| 4,362,911 | 12/1982 | Sears et al. | 200/517 X |
| 4,845,325 | 7/1989 | Burchett et al. | 200/345 |
| 4,864,084 | 9/1989 | Cardinale | 200/5 A |

FOREIGN PATENT DOCUMENTS

| | | | |
|---|---|---|---|
| 3607689 | 9/1987 | Fed. Rep. of Germany | 200/513 |
| 2107933 | 5/1983 | United Kingdom | 200/512 |
| 2122029 | 1/1984 | United Kingdom | 200/513 |

*Primary Examiner*—Henry J. Recla
*Assistant Examiner*—Glenn T. Barrett
*Attorney, Agent, or Firm*—Burns, Doane, Swecker & Mathis

[57] ABSTRACT

A push button device in which convex portions are provided on the lower surface of a button positioned to turn a switch mounted on a substrate ON and OFF. The convex portions are provided at a position symmetrical with a center axis of the button, and a resilient member is provided in contact with the lower surface of the button and placed in pressure contact with the convex portions. A smooth restoring force when the resilient member is restored from being and compression deformation is obtained through the joint use of an action of the convex portions of the button to bend the resilient member and a compression action caused by a small area. As a result, the switch can be turned ON and OFF without much pressure, and the button is always reliably returned to its original position when pressure is removed. Also, the convex portions engage the resilient member to prevent play.

8 Claims, 2 Drawing Sheets

PUSH BUTTON DEVICE

BACKGROUND OF THE INVENTION

This application is a continuation-in-part of application Ser. No. 299,636 filed Jan. 23, 1989 now abandoned.

FIELD OF THE INVENTION

This invention relates to a push button device which is used as an operating button, for example, for audio devices mounted on cars, home audio devices and the like.

PRIOR ART

FIG. 1 is a side view in section showing a conventional push button device, in which reference number 1 designates a panel for operation and display; 2, a button incorporated into the panel 1; 4, a switch mounted by soldering on a wiring substrate 3; 5, an illuminator for illuminating the button 2; 6, a conductive plate for shielding the wiring substrate 3 from static electricity through a clearance between the panel 1 and the button 2; and 7, a resilient member inserted and interposed between the button 2 and the conductive plate 6.

The function of this device is as follows. The panel 1 and the illuminator 5 for illuminating the button are fitted with each other. The button 2 is received within to project from a button receiving window of the panel. The conductive plate 6 provided to protect the substrate 3 from static electricity and to prevent leakage of stray light from the illuminator 5, and the resilient member 7 of a thickness b, is placed around the button 2 so that the latter may be held by elastic deformation, said thickness being reduced to a to urge the button 2 upwards. When the button 2 is pressed, the resilient member 7 is further compressed to turn the switch 4 ON or OFF, and when the button 2 is released, it is pushed back by a restoring force of the resilient member 7 returning to its initial thickness a and as the result, the button 2 is returned. Accordingly, the dimension is determined principally depending on the operating force of the button 2. For example, if the resilient member 7 is formed of foaming plastics, production precision must be increased with respect to the thickness b, in terms of the foaming rate and a quantity material. Furthermore, unless the push button is assembled so that the dimensions of the recess containing the resilient member is precisely maintained, a fixed button returning force cannot be obtained, and there sometimes occurs a clearance resulting in play of the button.

The conventional push button device is constructed as described above. Therefore, part manufacture (including determination of physical characteristics and dimensions) and assembly must be carried out with high precision. It is necessary to provide a sufficient fitting area between a hole of the resilient member and a contour of the button. Otherwise, if the button is pressed at its corner and tilts, it may become jammed in the hole of the resilient member so that it cannot be returned. Further, if a flexure of the resilient member is decreased so that the button may be lightly pushed, the depression when the button is not pressed becomes short, creating the problem that the button becomes loose. Therefore it is necessary to increase the flexure, as a consequence of which the necessary pressing pressure increases.

SUMMARY OF THE INVENTION

This invention is intended to solve the problems noted above. It is, therefore, a principal object of this invention to provide a push button device which can be easily assembled, which has a "soft touch" in switch ON-OFF operation after assembled, which is free from play, and which can be positively operated, without requiring highly accurate parts and assembly.

It is a further object of this invention to provide a push button device which is small in size, light-weight, easy to manufacture and inexpensive.

Other objects will become obvious from understanding of ensuing embodiments. Furthermore, if this invention shown in claims is actually carried out, those skilled in art should obtain many advantages not described herein.

The above and other objects of this invention will become apparent from the description of the specification, wherein convex portions are provided on the lower surface of a button which is pressed to turn a switch ON and OFF so that even when the button is not pressed, a bending deformation is applied to a resilient member by said convex portions, whereby a restoring force of the resilient member may always act on the lower surface of the button through the convex portions.

DETAILED DESCRIPTION OF THE PREFERRED EMBODIMENTS

Figure 1:
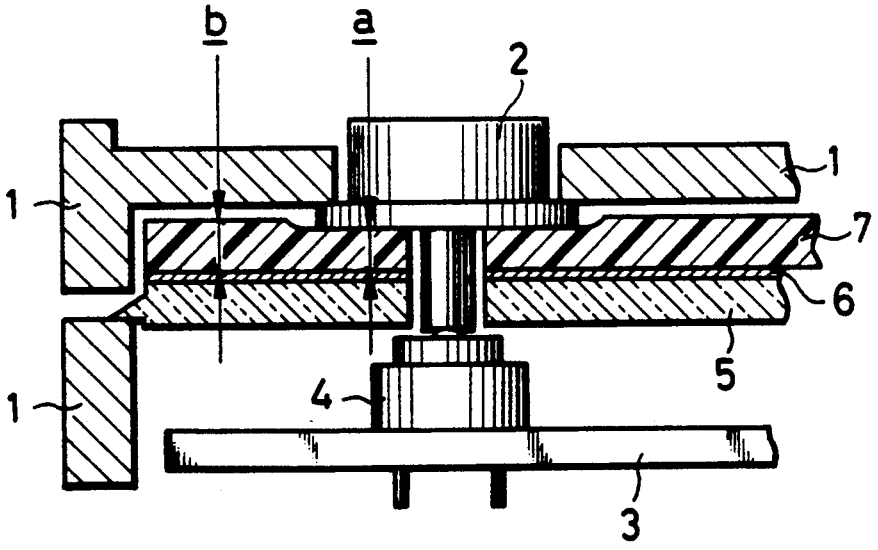
FIG. 1 (PRIOR ART)
FIG. 1 is a sectional side view showing a conventional push button device.
Figure 2B:
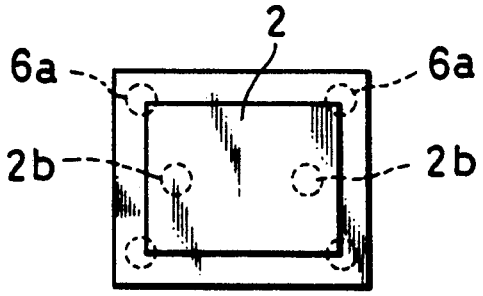
FIG. 2(B) is a front view of a button of said push button device.

One embodiment of this invention will be described with reference to the drawings. Numerals used in FIGS. 2(A) and 2(B) which are the same as those used in FIG. 1 indicate similar elements, the description of which will not be repeated. As can be appreciated from FIG. 2(A), a button 2 of the present invention is movable between a first, unpressed position (shown in FIG. 2(A)) and second, pressed position. Reference numeral *2b* designates a convex portion provided at a part of a button 2 to hold the resilient member 7, and *6a* designates a convex portion provided at a part of a conductive plate 6 to hold the resilient member 7. The convex portion *2b* and convex portion *6a* are designed in the illustrated example so that the convex portion *2b* is small in pitch while the convex portion *6a* is wide in pitch. By the provision of different pitches as described, a force pressing the button 2 compresses only the convex portions *2b* and *6a* and at the same time partly produces a bending deformation to turn a switch 4 ON or OFF. If the button 2 is released, it is returned to the first position by the force by which compression and bending deformation of the resilient member 7 tend to be restored. This force is a weak force in area ratio as compared to the conventional force by which the whole area of the back of the button 2 is deformed but the deformation force with respect to the pressing amount is assisted by the bending deformation due to a deviation of pitch between the convex portions 2b and 6a. There is thus not a sudden stiffening as in prior art devices and therefore a smooth tactile response is obtained. Further, the convex portions 2b and 6a are partly engaged into the resilient member 7, and therefore, even if button 2 is pressed with little force, there is no play in the button.

This effect is enhanced by providing a clearance or gap G between the flange on push button 2 and the confronting surface of resilient member 7 and a clearance or gap G' between the conductive plate 6 and the confronting surface of resilient member 7. This reduces the compressive component of the restoring force tending to urge push button 2 upwards so that the remaining restoring force is due primarily to bending of the resilient member 7. In the particular embodiment shown, the resilient member 7 is spaced away from the lower surface of the button 2 in a region between the periphery of the button 2 on the first convex portion 2b to create gap G. The resilient member 7 is also spaced away from the conductive plate or support surface 6 between the second convex portions 6a and a center axis of the button 2.

Furthermore, the upper surface side of the flange portion of button 2 is placed in contact with an edge of a button receiving window formed in the panel 1, and its lower surface side placed in contact with the resilient member 7 through said convex portion 2b so that the button 2 is always pressed and held by the restoring force of the resilient member 7 produced by the continuous bending deformation of the resilient member 7. Therefore, play of the button can be positively prevented irrespective of the dimensional precision of parts, assembling precision and the like, and movement of the button in a direction other than the button pressing direction is avoided. In other words, deviation of the button 2 in either direction within the button receiving window can be prevented. Accordingly, since a hole of the resilient member 7 can be enlarged so as to have a considerable allowance, even if a corner of the button is pressed so that the button is inclined, it fits into the hole of the resilient member 7 and is securely returned.

Figure 2A:
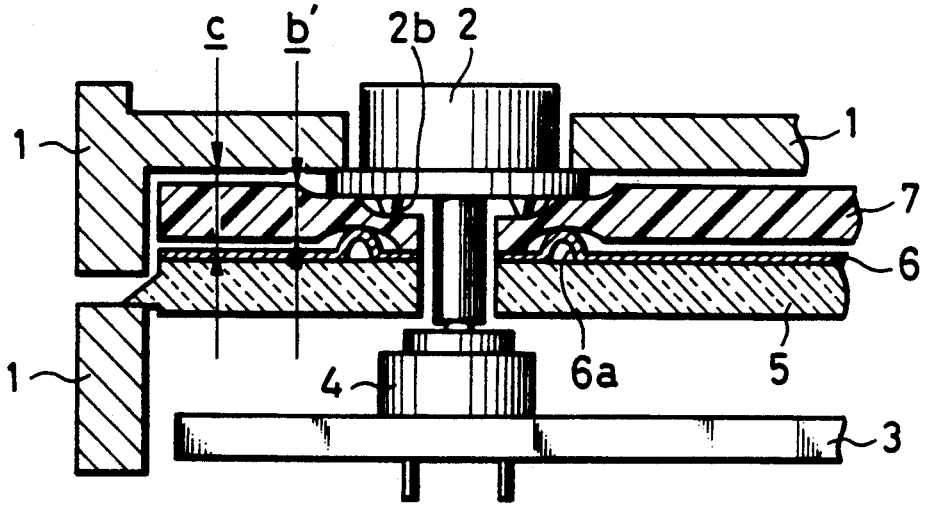
FIG. 2(A) is a sectional side view showing a push button device according to one embodiment of this invention.
Figure 3:
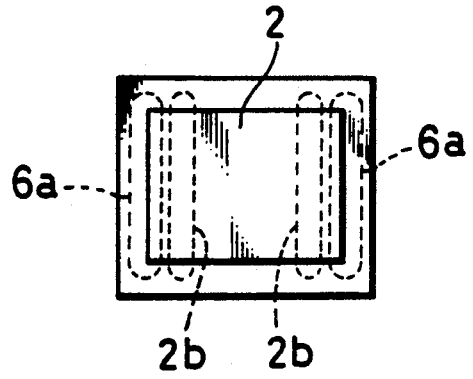
FIG. 3 is a front view of a button showing a further embodiment of this invention.

FIG. 3 shows a further example in which the shape of the convex portions 2b and 6a is changed from the aforementioned semi-spherical shape into an I shape. Both compression deformation and bending deformation contribute to button operation without a great pressing pressure, which is adapted to the case where the resilient member 7 is formed of a material which is soft, i.e., has a large foaming rate. As will be understood from these example, if the relationship between a thickness b' of the resilient member 7 and a clearance c of the storing space in FIG. 2(A) is set to b' c, the quality of the resilient member can be selected relatively freely. The contact area and shape may be combined accordingly. The pressure change rate causes the deformation area to be small with respect to the moving distance of the button, and therefore a dimension which is easily obtained and has an allowance (c−b' is sufficiently large) can be employed. A device that may be easily made can be obtained without requiring an increase in dimensional precision and assembling precision.

While in the above-described embodiment, an example has been shown in which the convex portions 2b and 6a are provided on both the button 2 confining the resilient member 7 and the conductive plate 6, it is to be noted that the convex portions may be provided on either of the button 2 or conductive plate 6. Further, while an example has been illustrated in which convex portions are provided on a part of the conductive plate 6, it is to be noted that the convex portions can be provided on the illuminator 5 or exclusive-use convex portions can be provided to achieve the effects similar to those of the above-described embodiments.

As described above, according to the present invention, the deformation area of the resilient member is reduced to make the change in pressing pressure slight. The change in pressing pressure is caused primarily by the bending deformation due to a pair of convex portions confining the resilient member therebetween, and the button is engaged with the resilient member due to the provision of convex portions. Therefore, a device without play can be obtained even if a light pressing pressure is applied to it, and a device having a pleasant operation sensation can be obtained at less cost.

What is claimed is:

1. A push button device for actuating a switch, comprising:

a button provided opposite an operation portion of the switch, said button being movable between a first, unpressed position and a second, pressed position, said button being pressable to said second position to turn the switch ON and OFF; and a resilient member provided in contact with a lower surface of said button, said resilient member providing a restoring force acting to restore said button to said first position when said button is pressed, said lower surface of said button having first convex portions in contact with said resilient member at positions symmetrical with a center axis of said button so that a continuous bending deformation is applied to said resilient member by said first convex portions even when said button is in said first position.

2. A push button device according to claim 1, wherein said first convex portions comprise convex bodies disposed parallel to each other and arranged symmetrically about a line passing through said center axis of said button.

3. A push button device according to claim 2, further comprising second convex portions having a pitch spacing different from a pitch spacing of said first convex portions, and provided proximate to but offset from a position opposed to said first convex portion on a surface of a support which supports said resilient member.

4. A push button device according to claim 1, wherein said resilient member is spaced away from said lower surface of said button in a region between a periphery of said button and said first convex portions.

5. A push button device for actuating a switch, comprising:

a button provided opposite an operation portion of the switch, said button being pressable to turn the switch ON and OFF; and a resilient member provided in contact with a lower surface of said button, said resilient member providing a restoring force with respect to the depression of said button;

said lower surface of said button having first convex portions in contact with said resilient member at positions symmetrical with a center axis of said button so that a bending deformation is applied by said first convex portions to said resilient member even when said button is not pressed, wherein said first convex portions comprise columnar bodies whose extreme ends are semi-spherical.

6. A push button device according to claim 5, further comprising second convex portions having a pitch spacing different from a pitch spacing of said first convex portions, and provided proximate to but offset from a position opposed to said first convex portions on a surface of a support which supports said resilient member.

7. A push button device for actuating a switch, comprising:

a button provided opposite an operation portion of the switch, said button being pressable to turn the switch ON and OFF;

a resilient member provided in contact with a lower surface of said button, said resilient member providing a restoring force with respect to the depression of said button, wherein said lower surface of said button includes first convex portions in contact with said resilient member at positions symmetrical with a center axis of said button, so that a bending deformation is applied by said first convex portions to said resilient member even when said button is not pressed; and second convex portions having a pitch spacing different from a pitch spacing of said first convex portions, and provided proximate to but offset from a position opposed to said first convex portions on a surface of a support which supports said resilient member.

8. A push button device as claimed in claim 7, wherein said resilient member is spaced away from said support surface in a region between said second convex portions and said center axis of said button.

* * * * *